US006540161B1

(12) United States Patent
Gordon

(10) Patent No.: US 6,540,161 B1
(45) Date of Patent: Apr. 1, 2003

(54) FUEL INJECTION VALVE FOR INTERNAL COMBUSTION ENGINES

(75) Inventor: Uwe Gordon, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 47 days.

(21) Appl. No.: 09/856,970

(22) PCT Filed: Sep. 2, 2000

(86) PCT No.: PCT/DE00/03019

§ 371 (c)(1),
(2), (4) Date: Dec. 26, 2001

(87) PCT Pub. No.: WO01/23755

PCT Pub. Date: Apr. 5, 2001

(30) Foreign Application Priority Data

Sep. 30, 1999 (DE) ..... 199 46 906

(51) Int. Cl.[7] ..... F02M 39/00

(52) U.S. Cl. ..... 239/533.3; 239/533.9; 239/533.12

(58) Field of Search ..... 239/88–92, 96, 239/533.2–533.12; 123/467

(56) References Cited

U.S. PATENT DOCUMENTS 4,285,471 A * 8/1981 Eblen et al.
4,403,740 A * 9/1983 Eblen et al. ..... 239/533.12
4,669,668 A * 6/1987 Owaga
4,852,808 A * 8/1989 Yamamoto ..... 239/533.3
5,244,152 A * 9/1993 Hofmann ..... 239/533.4

FOREIGN PATENT DOCUMENTS

| | | | |
|---|---|---|---|
| DE | 3839812 | * | 5/1990 |
| DE | 19504849 | * | 8/1996 |
| GB | 2314121 | * | 12/1997 |

* cited by examiner

*Primary Examiner*—Michael Mar
*Assistant Examiner*—Dinh Q. Nguyen
(74) *Attorney, Agent, or Firm*—Ronald E. Greigg

(57) ABSTRACT

A fuel injection valve for internal combustion engines, having a valve body in which a valve member is disposed, which valve member changes into a spring plate, which is disposed in a spring chamber that receives the closing spring provided with a valve stop face on an end face. A control piston is provided defining a hydraulic control chamber, which control piston protrudes into the spring chamber, whose end face toward the combustion chamber forms a stroke stop face. As a function of pressure in the control chamber, the control piston can be moved counter to the closing force of a restoring spring from a first stroke position, remote from the valve member, toward the valve member into a second stroke position, where the control piston limits the maximum opening stroke (h) of the valve member to a partial stroke ($h_T$).

14 Claims, 3 Drawing Sheets

66
88
78
62
60
5
6
hs
56
2
57
46
58
64
3
43
51
362
53
8
49
1
40
36
27
361
33
44
18
hT
30
41
14
h
15
32
19
4
11
24
101
7
102
23
10
25
26
22
28
13
21
16
20
17

FUEL INJECTION VALVE FOR INTERNAL COMBUSTION ENGINES

CROSS-REFERENCE TO RELATED APPLICATIONS

This application is a 35 USC 371 application of PCT/DE 00/03019 filed on Sep. 2, 2000.

BACKGROUND OF THE INVENTION

1. Field of the Invention

The invention is directed to fuel injection valves, and particularly to such a valve for internal combustion engines.

2. Brief Description of the Prior Art

One prior art fuel injection valve, known from German Published, Nonexamined Patent Application DE 196 45 900 A1 employs a pistonlike valve member that is movable axially counter to the force of a closing spring disposed in a bore. The valve member is guided in the bore in a portion remote from the combustion chamber and, toward the combustion chamber, changes into a closing head that is guided in a slide bore which is embodied as a blind bore. On the wall of the slide portion of the bore, there are a plurality of axially offset injection openings, which in the closed state of the valve member are covered by the closing head. By the fuel pressure on the pressure shoulder disposed in the pressure chamber, the valve member is lifted from the valve seat, and as a result the pressure chamber communicates with the lower pressure chamber via a transverse bore and a middle bore embodied in the valve member. The control edge of the closing head, in the opening stroke motion, opens the injection openings in succession, and as a result over the increasing entire injection cross section, a shaping of the course of injection is achieved. When the stroke stop face reaches the stop face embodied in the valve body, the opening stroke is concluded.

In such an injection valve, all the injection openings are opened in the opening stroke motion. In the partial-load range of the engine, the injection quantity is reduced compared to full load, which in this injection valve means on the one hand that the injection pressure is reduced and on the other that the opening time of the injection valve is shortened. Neither of these aspects is optimal with regard to either optimal atomization and distribution of the fuel in the combustion chamber or low exhaust emissions.

SUMMARY OF THE INVENTION

The fuel injection valve of the invention for internal combustion engines, has the advantage over the prior art that the opening stroke can be limited by the hydraulically controlled control piston to a portion of the maximum stroke, and as a result only some of the injection openings, or only a partial cross section of the injection openings, is opened.

One embodiment of the invention has the advantage that the maximum stroke can be changed in a simple way, by replacing the relatively readily accessible control piston with another of a different height.

Because of the multi-part construction of the control piston in one embodiment, easy installation of the fuel injection valve is obtained. Depending on the needs for the design of the fuel injection valve, the restoring spring can engage either the hydraulic piston or the thrust rod, which makes it possible to use the stroke stop, which according to the invention is hydraulically variable, in various fuel injection valves. A further embodiment has the advantage that the injection cross section can be reduced by providing that the injection opening is opened only in part.

In another embodiment, the fuel injection valve has the advantage that the control line communicates with a high-pressure collection chamber via a control valve, so that no additional high-pressure fuel source is required for the control pressure in the control chamber.

In a further embodiment, it is advantageously possible to relieve the control line to the fuel tank within a very brief time and thus put the control piston into the first stroke position. It is accordingly possible to change very quickly between the partial stroke and the maximum stroke of the valve member.

BRIEF DESCRIPTION OF THE DRAWINGS

Further advantages and advantageous features of the subject of the invention will be apparent from the description contained herein below, taken in conjunction with the drawings, in which.

DESCRIPTION OF THE PREFERRED EMBODIMENTS

Figure 1:
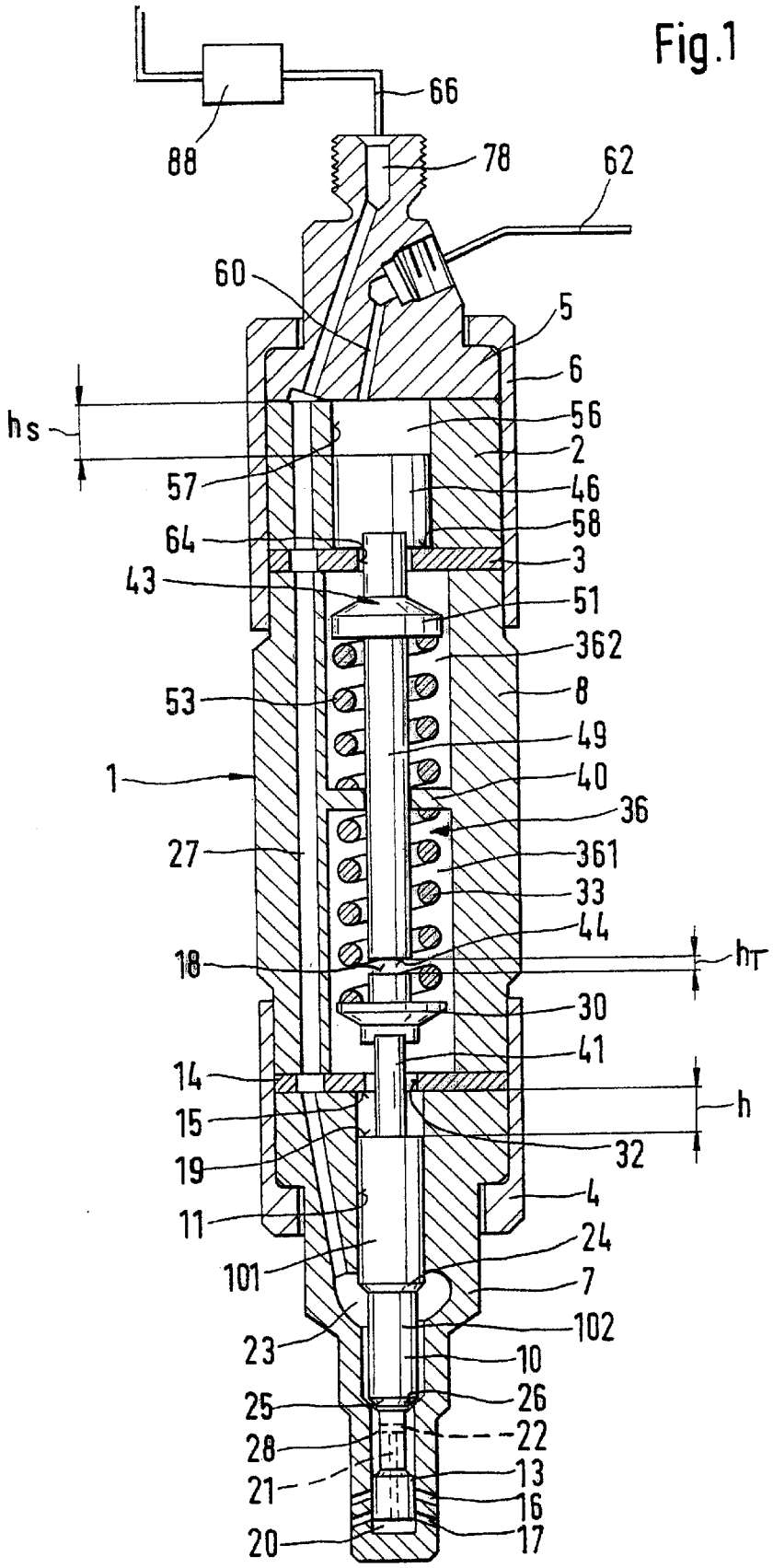
FIG. 1 shows a longitudinal section through the fuel injection valve.
Figure 2:
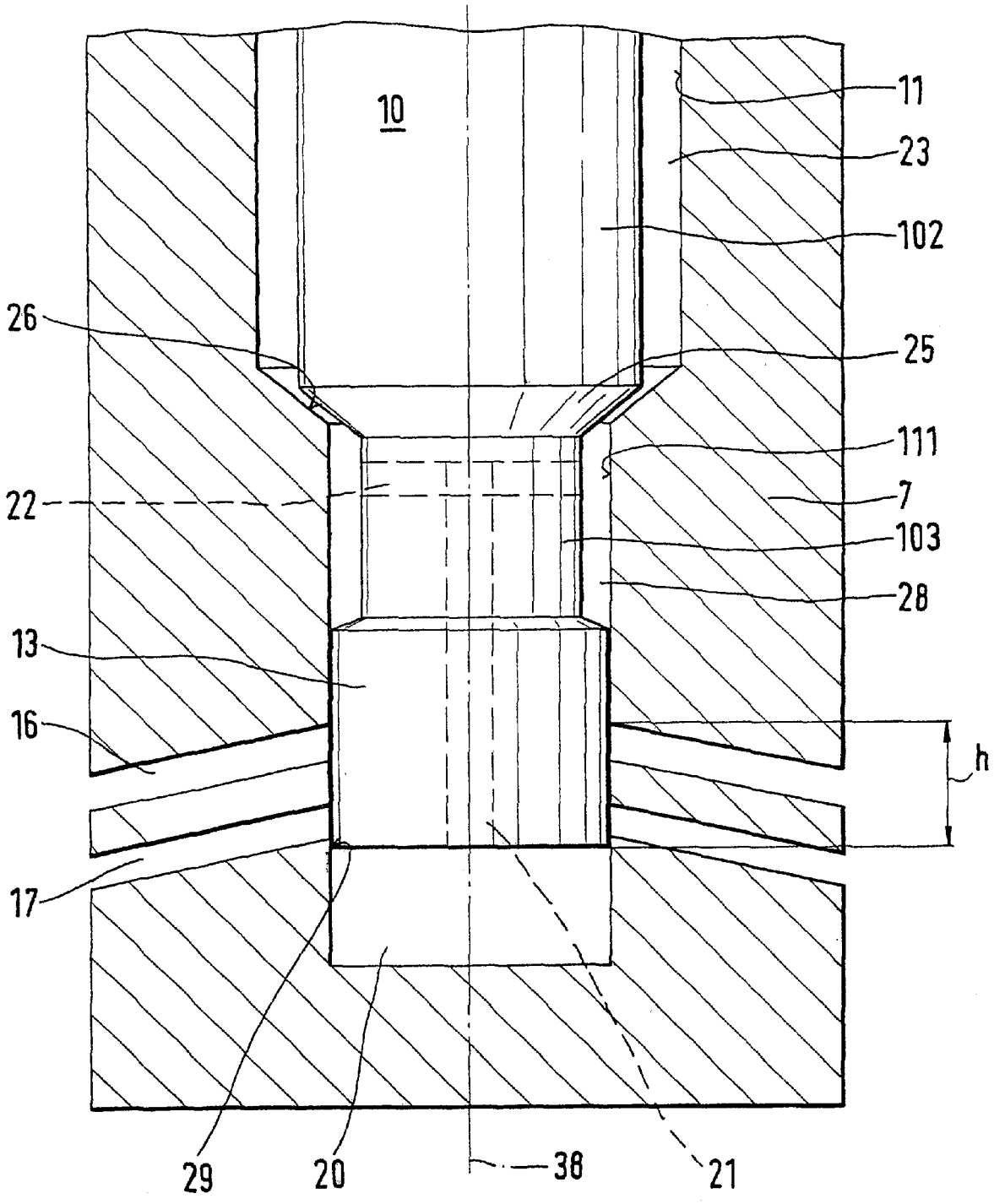
FIG. 2 is an enlarged view of the fuel injection valve of FIG. 1 in the region of the injection openings.

Referring now to the drawings in detail, in FIGS. 1 and 2, a fuel injection valve for internal combustion engines, in particular self-igniting internal combustion engines, is shown. First, the basic construction of the fuel injection valve will be described in conjunction with FIGS. 1 and 2, where FIG. 2 shows an enlarged detail of FIG. 1, and then the mode of operation of the fuel injection valve will be described.

The fuel injection valve has a multi-part valve body 1. A valve base body 7 disposed toward the combustion chamber, toward the bottom in FIG. 1, is braced with a lock nut 4 against a valve holding body 8 with the interposition of a lower shim 14. Toward the opposite side, remote from the combustion chamber, of the valve holding body 8, a valve connection body 5 is braced with a lock nut 6, with the interposition of a valve control body 2 and an upper shim 3.

In the valve base body 7, there is a bore 11 embodied as a blind bore, which narrows toward the combustion chamber and which on the end toward the combustion chamber changes over into a slide portion 111. In the bore 11, a pistonlike, axially movable valve member 10 is disposed, which with an upper portion 101, remote from the combustion chamber, is guided in the bore 11 and which tapers toward the combustion chamber, forming a pressure shoulder 24 that is disposed in a pressure chamber 23 surrounding the valve member 10.

The middle portion 102 of the valve member 10, adjoining the upper portion 101 toward the combustion chamber, narrows further toward the combustion chamber and changes into a lower portion 103. At the transition from the middle portion 102 to the lower portion 103 of the valve member 10, a valve sealing face 25 is formed, which cooperates with a valve seat 26 that is formed by a cross-sectional reduction of the bore 11 toward the combustion chamber.

The lower portion 103 of the valve member 10 changes, toward the combustion chamber, into a closing head 13 that forms the end of the valve member 10. The closing head 13 is guided sealingly in the slide portion 111 of the bore 11 the form of a blind bore and defines a lower pressure chamber 20 formed by the bore 11. FIG. 2 shows an enlarged view of the fuel injection valve in the region of the closing head 13.

Between the lower portion 103 of the valve member 10 and the slide portion 111 of the bore 11, an annular conduit 28 is formed, which surrounds the valve member 10 over its entire circumference. In the lower portion 103 of the valve member 10, at least one transverse bore 22 is formed in the radial direction, and a middle bore 21 is embodied, beginning at the transverse bore 22 and extending through the end of the closing head 13 toward the combustion chamber, coaxially to the longitudinal axis 38 of the valve member 10. The transverse bore 22 and the middle 21 are embodied such that they intersect in the valve member 10 and thus establish a communication between the lower pressure chamber 20 and the annular conduit 28. On the end of the closing head 13 toward the combustion chamber, a control edge 29 is formed. Two axially offset injection openings 16, 17 are embodied in the wall of the slide portion 111 of the bore 11. These openings are covered in the closed state of the fuel injection valve by the closing head 13, so that the injection openings 16, 17 communicate neither with the lower pressure chamber 20 nor with the annular conduit 28. When the fuel injection valve is closed, the annular conduit 28 and the lower pressure chamber 20 are separated from the pressure chamber 23 by the valve sealing face 25 contacting the valve seat 26.

The bore 11 is adjoined, on the end remote from the combustion chamber, by a spring chamber 36 formed in the valve holding body 8; in this chamber, by means of a cross-sectional reduction, a spring support 40 is embodied, which divides the spring chamber 36 into a lower spring chamber 361 and an upper spring chamber 362. The upper portion 101 of the valve member 10 merges, on the end remote from the combustion chamber, with a smaller-diameter intermediate pin 41, which protrudes through a central bore 32, embodied in the lower shim 14, as far as the inside of the lower spring chamber 361. The intermediate pin 41 is connected to a spring plate 30 disposed in the lower spring chamber 361, and a valve stop face 18 is embodied on the face end of this spring plate remote from the combustion chamber. The transition from the valve member 10 to the intermediate pin 41 forms a stop shoulder 19, and the transition from the bore 11 to the smaller-diameter central bore 32 of the shim 14 forms a stroke stop 15 by means of the shim 14. The axial spacing of the stop shoulder 19 from the stroke stop 15, in the closed state of the valve member 10, defines the maximum opening stroke h. Between the spring plate 30 and the spring support 40, a closing spring 33 is disposed with initial tension, preferably being embodied as a helical compression spring. It presses the spring plate 30 and thus, via the intermediate pin 41, the valve member 10 with the valve sealing face 25 against the valve seat 26.

In the valve control body 2, coaxially with the longitudinal axis 38 of the valve member 10, a guide bore 57 is formed, which communicates with the upper spring chamber 362 via a central bore 64 embodied in the upper shim 3. A control piston 43 is disposed in the guide bore 57 and in the spring chamber 36 and essentially comprises two parts: a hydraulic piston 46, which is guided in the guide bore 57, and a thrust rod 49, which is connected to the hydraulic piston 46 and from there protrudes through the upper spring chamber 362 into the inside of the lower spring chamber 361. The thrust rod 49 is guided in the spring support 40, and its face end toward the combustion chamber is embodied as a stroke stop face 44. A spring plate 51 is disposed on the thrust rod 49 in the upper spring chamber 362, and between this plate and the spring support 40, a restoring spring 53 is disposed in a prestressed manner; the restoring spring 53 surrounds the thrust rod 49 and is preferably embodied as a helical compression spring. The valve connection body 5, guide bore 57 and hydraulic piston 46 define a control chamber 56, which can be filled with high pressure fuel and which communicates with a control line, (FIG. 3) via a control inlet conduit 60 embodied in the valve connection body 5 and via a control inlet line 62. The transition from the guide bore 57 to the smaller-diameter central bore 64 of the upper shim 3 forms a control piston stop 58. A high-pressure fuel connection 78 is disposed in the valve connection body 5, and a high-pressure inlet line 66 discharges into the fuel injection valve at this connection 78. The high-pressure fuel connection 78 communicates with the pressure chamber 23 via an inlet conduit 27 extending in the valve connection body 5, the valve control body 2, the upper shim 3, the valve holding body 8, the lower shim 14, and the valve base body 7.

Figure 3:
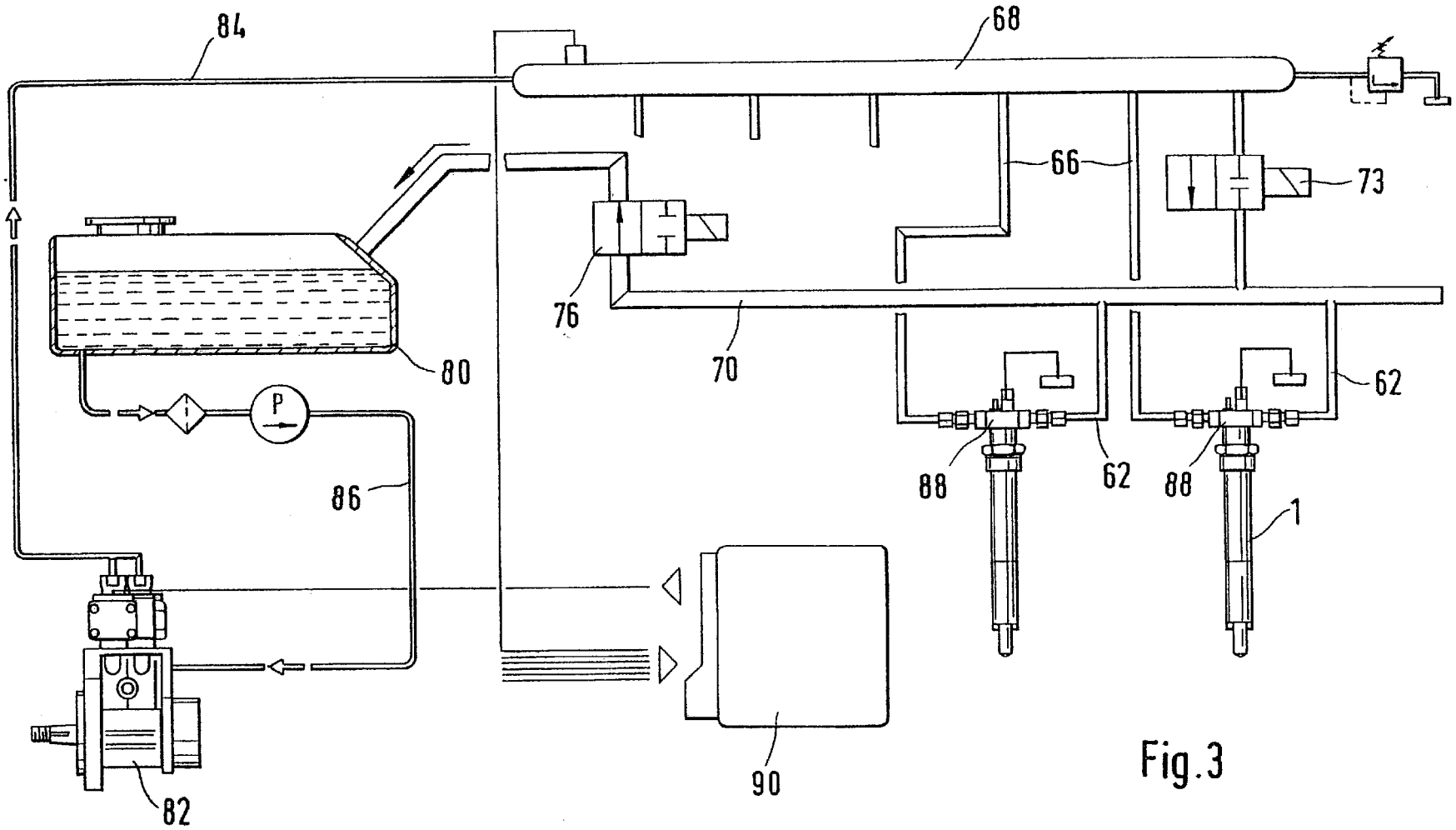
FIG. 3 shows the schematic layout of the supply to the fuel injection valve, with high fuel pressure and control pressure.

In FIG. 3, the fuel supply system for supplying high fuel pressure to the fuel injection valves of an internal combustion engine is shown schematically. From a fuel tank 80, fuel is delivered to a high-pressure fuel pump 82 via a low-pressure line 86. From this pump, the fuel is pumped at high pressure via a high-pressure line into a high-pressure collection chamber 68, where a largely constant high pressure is maintained. From the high-pressure collection chamber 68, one high-pressure inlet line 66 leads to each fuel injection valve; the high-pressure inlet line supplies the pressure chamber 23 with fuel via a fuel metering valve 88 and the inlet conduit 27 extending within the fuel injection valve. The fuel metering valve 88 opens and closes the communication from the high-pressure inlet line 66 to the inlet conduit 27 and controls the injection event by way of the instant and duration of opening. The control inlet line 62, communicating with the control chamber 56 via the control inlet conduit 60, of all the fuel injection valves is connected to a control line 70, which can be made to communicate with the high-pressure collection chamber 68 via a control valve 73. If the control line 70 is filled with fuel at high pressure via the high-pressure collection chamber 68, then a relief of the fuel pressure into the fuel tank 80 can take place via a relief valve 76. Via the control unit 90, not only can the individual components of the fuel injection system be controlled, but the operating state can also be detected, via various sensors not shown in the drawing.

The mode of operation of the hydraulically adjustable stroke stop is as follows:

If a fuel pressure whose resultant force on the hydraulic piston 46 is greater than the force of the restoring spring 53 prevails in the control chamber 56, then the hydraulic piston 46 and thus the entire control piston 43 moves, beginning from a first, upper stroke position, in which the hydraulic piston 46 rests on the valve connection body 5, toward the valve member 10 into a second, lower stroke position, until the hydraulic piston 46 rests on the control piston stop 58. As a result of this motion, the stroke stop face 44 of the thrust rod 49 is also displaced toward the valve member 10 and thus decreases the axial spacing of the stroke stop face 44 from the valve stop face 18 of the valve member 10. In the lower stroke position of the control piston 43 and in the closed state of the valve member 10, the axial spacing of the stroke stop face 44 from the valve stop face 18 is equal to the partial stroke hT, which is less than the maximum opening stroke h that is defined by the axial spacing between the stop shoulder 19 of the valve member 10 and the stroke stop 15. If the fuel pressure in the control chamber 56 is reduced so far that the resultant force on the hydraulic piston 46 is less than the force of the restoring spring 53, then by the force of the restoring spring 53, the thrust rod 49 and thus also the hydraulic piston 46 moves in the direction of the valve connection body 5, until the hydraulic piston 46, after traversing the control stroke hs comes to rest on the valve connection body 5. As a result, the stroke stop face 44 of the thrust rod 49 also moves away from the valve member 10. The control stroke hs is dimensioned such that the axial spacing of the stroke stop face 44 from the valve stop face 18, in this upper stroke position of the control piston 43, is greater than the maximum opening stroke h.

The mode of operation of the fuel injection valve is as follows:

If the fuel metering valve 88 is opened, the pressure in the high-pressure collection chamber 68 is propagated through the inlet conduit 27 as far as the pressure chamber 23. The resultant force in the axial direction on the pressure shoulder 24 thus increases, until this force is greater than the force of the closing spring 33. With the valve sealing face 25, the valve member 10 lifts away from the valve seat 26, and as a result the pressure chamber 23 communicates with the annular conduit 28 and thus also, via the transverse bore 22 and the middle bore 21, communicates with the lower pressure chamber 20. As soon as the control edge 29 reaches the injection opening 17, fuel is injected via the injection opening 17 into the combustion chamber. The further course of the opening stroke motion depends on the stroke position of the control piston 43: If the control piston 43 is in the first, upper stroke position, then the valve member 10 executes the maximum opening stroke h, until, with its stop shoulder 19, it comes into contact with the stroke stop 15; the shim 14 forms the stroke stop 15 disposed rigidly in the valve body 1. In the course of the opening stroke motion of the valve member 10, the control edge 29 first opens the injection opening 17 toward the combustion chamber and then the injection opening 16 offset from it and remote from the combustion chamber. The injection accordingly takes place first through the injection opening 17 and then through both injection openings 16, 17 jointly. the closing motion of the valve member 10 takes place whenever the pressure in the pressure chamber 23 drops far enough that the resultant force on the valve member 10 at the pressure shoulder 24, the valve sealing face 25 and the face end, toward the combustion chamber, of the valve member 10 in the lower pressure chamber 20 becomes less than the force of the closing spring 33. The valve member 10 is moved by the closing spring 33 in the direction toward the combustion chamber, until the valve sealing face 25 comes to rest on the valve seat 26. This disconnects the pressure chamber 23 from the lower pressure chamber 20, and the closing head 13 closes the injection openings 16, 17.

If conversely the control piston 43 is in the lower stroke position, then the valve member 10 in its opening stroke motion, after traversing the partial stroke $h_T$, comes to rest with the stroke stop face 44 on the valve stop face 18. The partial stroke $h_T$ is dimensioned such that the control edge 29 of the closing head 13, at the end of the partial stroke motion, rests between the injection openings 16 and 17, so that only the injection opening 17 nearer the combustion chamber communicates with the pressure chamber 23, and only through the injection opening 17 is fuel injected into the combustion chamber. The stop of the valve member 10 on the control piston 43 is hydraulically damped by the control chamber 56. The closing motion of the valve member 10 is initiated in the same way as the closing motion after the execution of the maximum opening stroke h.

The control of the control piston 43 is effected via the pressure in the control line 70. Since a largely constant high fuel pressure always prevails in the high-pressure collection chamber 68, the fuel pressure in the control line 70 can be raised up to the pressure in the high-pressure collection chamber 68 at any time by opening the control valve 73. As a result, the control piston 43 moves as described above from the first, upper stroke position to the second, lower stroke position, and the opening stroke of the valve member 10 is limited to a partial stroke h, of the maximum opening stroke h. The partial stroke $h_T$ amounts to from 40 to 60%, and preferably approximately 50%, of the maximum opening stroke h. The relief of the control line 70 takes place into the fuel tank 80, via the relief valve 76. It is thus possible, within only a few injection cycles, to reduce the pressure in the control line 70 and thus to move the control piston 43 from the second, lower stroke position to the first, upper stroke position, as a result of which the valve member 10 can again execute the maximum opening stroke h. Because of the available high-pressure collection chamber 68, it is accordingly unnecessary to have a separate high-pressure fuel source for the control line 70.

As an alternative to the fuel injection valve described above, it can also be provided that the maximum opening stroke of the valve member 10 in the first, upper stroke position of the control piston 43 is defined by the axial spacing of the stroke stop face 44 from the valve stop face 18. The control stroke hs and the injection openings 16, 17 are embodied in this case such that at the maximum opening stroke of the valve member 10, both injection openings are opened. In the first, upper stroke position of the control piston 43, the valve member 10 comes to rest on the control piston as a stop, so that the stroke stop 15 can be omitted.

In a further alternative embodiment of the fuel injection valve described above, it is provided that the thrust rod 49 of the control piston 43 is omitted, and instead, the valve member 10 protrudes past the spring plate 30 to the inside of the upper spring chamber 362. The end face of the valve member 10 toward the hydraulic piston is embodied in this case as a valve stop face 18, which in the second, lower stroke position of the hydraulic piston 46 comes to rest, in the opening stroke motion, directly on the hydraulic piston 46. In this embodiment, the restoring spring 53 is braced between the spring support 40 and the hydraulic piston 46.

In still another alternative embodiment of the above-described fuel injection valve, it is provided that instead of a plurality of axially offset injection openings, only one or more injection openings 16, 17 embodied at the same height are embodied in the slide portion 111 of the bore 11. The maximum opening stroke h and the partial stroke $h_T$ are dimensioned in this case such that the injection opening is opened only partially by the control edge 29 in the partial stroke $h_T$, and as a result a further reduction in the entire injection cross section is obtained. The full cross section of the injection opening is opened when the maximum opening stroke h has been executed.

The foregoing relates to preferred exemplary embodiments of the invention, it being understood that other variants and embodiments thereof are possible within the spirit and scope of the invention, the latter being defined by the appended claims.

What is claimed is:

1. In a fuel injection valve for internal combustion engines, having a valve body (1), in which a bore (11)

formed as a blind bore is embodied so that toward a combustion chamber it changes into a slide portion or bore (111), on a wall of which at least one injection opening (16, 17) is disposed, and having a pistonlike valve member (10), which is guided in a region of the bore (11) remote from the combustion chamber and is axially movable counter to the force of at least one closing spring (33) and which on its end toward the combustion chamber changes into a closing head (13) that is guided in the slide portion or bore (111) of the bore (11) and that closes the injection opening (16, 17), the injection opening (16, 17) being openable entirely or in part by an inward-oriented opening stroke motion of the valve member (10), as a result of which an injection cross section changes as a function of an opening stroke of the valve member (10), which valve member (10), for limiting its opening stroke motion to a maximum opening stroke (h) comes to rest on a stop, and on which valve member a pressure shoulder (24) acting in an opening direction is embodied, the improvement comprising, in a region of the valve body (1) remote from the combustion chamber, a control piston (43) is disposed at least approximately coaxially to the valve member (10), the control piston being guided axially movably in a control bore (57) embodied in the valve body (1) and defining a control chamber (56), and fuel under pressure can be delivered to the control chamber (56), by means of which the control piston (43) can be moved, counter to a force of a restoring spring (53), from a first stroke position toward the valve member (10) into a second stroke position, as a result of which the control piston (43) acts as a stop (44) for the valve member (10) and limits the opening stroke motion of the valve member (10) to a partial stroke ($h_T$) that is less than the maximum stroke (h).

2. The fuel injection valve of claim 1, wherein the maximum stroke (h) of the valve member (10) in the first stroke position of the control piston (43) is formed by a stroke stop (15) embodied rigidly on the valve body (1).

3. The fuel injection valve of claim 1, wherein the control piston (43), in its second stroke position, acts as a stop for the valve member (10) to limit the opening stroke motion of the valve member to the partial stroke ($h_T$).

4. The fuel injection valve of claim 1, wherein the control piston (43) is embodied in two parts, and a first part forms a hydraulic piston (46) and defines the control chamber (56), and a second part, which is connected to the hydraulic piston (46), is embodied as a thrust rod (49), which acts as the stop (44) for the valve member (10).

5. The fuel injection valve of claim 4, wherein the restoring spring (53) is braced on the hydraulic piston (46).

6. The fuel injection valve of claim 4, wherein the restoring spring (53) is braced on the thrust rod (49).

7. The fuel injection valve of claim 1, wherein the control piston (43), in its second stroke position, defines the opening stroke of the valve member (10) to the partial stroke ($h_T$) that amounts to approximately 40–60% of the maximum opening stroke (h), and preferably approximately 50%.

8. The fuel injection valve of claim 1, wherein in the wall of the slide bore (111), at least two injection openings (16, 17) are embodied, axially offset from one another.

9. The fuel injection valve of claim 8, wherein in the limitation of the opening stroke of the valve member (10) to the partial stroke ($h_T$), only one injection opening (17) is opened.

10. The fuel injection valve of claim 8, wherein the closing head (13) at the maximum opening stroke (h) of the valve member (10) opens both injection openings (16, 17) one after the other in the course of the opening stroke motion.

11. The fuel injection valve of claim 1, wherein the closing head (13), upon a limitation of the opening stroke to the partial stroke ($h_T$) in the opening stroke motion of the valve member (10), opens the at least one injection opening (16, 17) only partially.

12. The fuel injection valve of claim 1, wherein the fuel injection valve communicates via a high-pressure inlet line (66) with a high-pressure collection chamber (68).

13. The fuel injection valve of claim 12, wherein the control chamber (56) communicates, via an inlet bore (60) embodied in the valve body (1) and via a fuel inlet valve (62), with a control line (70) that communicates with the high-pressure collection chamber (68) via a control valve (73).

14. The fuel injection valve of claim 13, wherein the control line (70) can be relieved to a fuel tank (80) via a relief valve (76).

* * * * *